US005941642A

United States Patent [19]

Darmstadter

[11] Patent Number: 5,941,642

[45] Date of Patent: Aug. 24, 1999

[54] SELF-CONTAINED FLUID DISPENSING SYSTEM

[76] Inventor: Jon D. Darmstadter, 736 Sycamore La., Glencoe, Ill. 60022

[21] Appl. No.: 09/005,627

[22] Filed: Jan. 9, 1998

[51] Int. Cl.[6] ..... B65D 30/16

[52] U.S. Cl. ..... 383/207; 383/104; 383/116; 383/906

[58] Field of Search ..... 383/202, 207, 383/208, 209, 104, 116, 200, 38, 40, 906

[56] References Cited

U.S. PATENT DOCUMENTS

| | | | |
|---|---|---|---|
| 2,999,627 | 9/1961 | Reinhardt | 383/200 X |
| 3,051,368 | 8/1962 | Schneider et al. | 383/209 |
| 3,074,612 | 1/1963 | Schneider | 383/906 X |
| 3,144,976 | 8/1964 | Freshour | 383/200 X |
| 3,380,644 | 4/1968 | Doyen et al. . | |
| 3,545,604 | 12/1970 | Gunther, Jr. | 383/202 X |
| 3,568,870 | 3/1971 | Elston . | |
| 3,746,197 | 7/1973 | Sather . | |
| 3,799,914 | 3/1974 | Schmit et al. | 383/200 X |
| 4,411,359 | 10/1983 | Franco . | |
| 4,448,316 | 5/1984 | Hiroshige . | |
| 5,150,815 | 9/1992 | Saklad . | |
| 5,253,779 | 10/1993 | Lee . | |
| 5,348,217 | 9/1994 | Bettle et al. . | |
| 5,353,955 | 10/1994 | Kaufman et al. . | |
| 5,385,264 | 1/1995 | Kaufman et al. . | |
| 5,437,389 | 8/1995 | Kaufman et al. . | |

FOREIGN PATENT DOCUMENTS

| | | | |
|---|---|---|---|
| 6127562 | 5/1994 | Japan | 383/104 |

OTHER PUBLICATIONS

U.S. Trademark Registration No. 1,418,517, Nov. 1987.
2Photos of Capri Sun Package.

*Primary Examiner*—Jes F. Pascua
*Attorney, Agent, or Firm*—Charles C. Valauskas

[57] ABSTRACT

A system for packaging and dispensing fluids including a flexible package having a removable margin portion and retention elements by which a tube may be held in a certain position within the package such that, when the removable margin is detached and pressure is applied to the exterior surface of the package sides, the dispensing end of the tube is indirectly pushed out from within the package inner volume and above the margin of the package for sanitarily dispensing fluid and, upon release of the pressure, the tube may slide back within the inner volume for the sanitary storage of the tube.

7 Claims, 3 Drawing Sheets

SELF-CONTAINED FLUID DISPENSING SYSTEM

BACKGROUND AND DESCRIPTION OF THE INVENTION

The present invention relates to a system for packaging and dispensing fluids. More particularly, the invention relates to a system including a flexible package having a removable margin portion and retention elements by which a dispensing tube may be confined to a certain position within the package and, when the removable margin is detached, the sides of the package may be manipulated to indirectly push the dispensing end of the dispensing tube out from within the package inner volume and above the margin of the package in order to sanitarily dispense the fluid from the tube as needed. The system is an improvement to the package described in U.S. Pat. No. 3,380,646 issued on Apr. 30, 1968 to L. Doyen et al. for "Container of Plastic Material and Method of Producing Same".

A variety of bottles and other containers are known for holding liquids that require a spout or tube to be used in order to pour or draw a liquid out from the container. However, many such known containers have a variety of disadvantages associated with them that limit their usefulness.

The spout or tube that is necessary to pour or draw liquid from some such containers is an element that is not retained on or within or united to the container but is maintained completely separate from the container. Without the spout or tube, the container cannot function as intended. If sanitary conditions are to be maintained during the pouring or dispensing of the liquid from the container, the separate spout or tube must be maintained in a sanitary condition such as by the individual wrapping of the spout or tube. The need for the separate spout or tube is inconvenient for the consumer. The need for the separate wrapping of the spout or tube adds additional cost to the entire packaging system.

Other of such containers require the consumer to use his or her hands to pull a straw out from or push a straw into the container or to manipulate a mouthpiece so that the fluid can be drawn up from the opened container through the straw or the mouthpiece. While the straw or mouthpiece may have been maintained in a sanitary state prior to manipulation, the handling of the straw or mouthpiece—in order to place the straw or mouthpiece into the proper position so that fluid may be drawn up and through and put from the dispensing end—may place dirt, bacteria, and viruses onto this end—the same that must be placed into the user's mouth to receive the liquid. Such handling poses a health risk particularly for children or older individuals or those that may be already suffering from an illness and may be required to avoid any additional health risks.

Other containers are complex arrangements that utilize specialized structures or multiple components to facilitate the dispensing of packaged fluid. For example, some such containers require the use of a stiff and/or pointed straw or other tool in order to puncture the container and thereby be able to dispense liquid from the container. Other containers provide straws or tubes on or within the container that have a specialized construction that allow the straw or tube to be compressed and expand when the package is opened. Other such containers include straws having certain mouthpiece structures and segments that require the straw to be directly manipulated so that the packaged fluid can be drawn up into the mouthpiece. Other containers are structured such that the straw or other tool that allows fluid to be drawn up from the container is carried on the exterior of the container. Such an exterior container location requires that either the fluid container and straw or dispensing tool or just the straw or dispensing tool be wrapped in additional protective wrapping material in order to maintain the straw or dispensing tool in a sanitary condition prior to the opening of the container and the straw or dispensing tool to be somehow bound to the container surface. Complex, multi-component structures requiring a number of assembly steps such as those typically are costly to manufacture and, as a result, may be more costly to the consumer.

The package described in the above-mentioned U.S. Pat. No. 3,380,646 comprises a container having two faces and a bottom part that is an extension of the two faces. The bottom part is described a being folded in so as to form a W-section with the faces. The container includes two lateral welds through the height of the faces. The drawings of the container described in that patent show the lateral welds as being parallel to each other. The package includes oblique or lateral welds or a curvilinear weld. The base of the package is described as being in the shape of a hexagon or a rhombus.

A demand therefore exists for a drinking system that is of a simplified construction—and that therefore can be manufactured easily and at a low cost—and is self-contained such that a user may easily transport the packaged fluid and open the package quickly and dispense fluid from the package without the need for any additional elements or tools or the direct handling of the dispensing end of the dispensing tube contained within the package. The present invention satisfies the demand.

SUMMARY OF THE INVENTION

The present invention is directed to a self-contained system including a dispensing tube by which fluid may be drawn from a package without the need for the direct manipulation of the dispensing end of the dispensing tube positioned within the inner volume of the package.

The package of the present invention includes a surrounding wall formed of flexible material suitable to retain fluid within an inner volume. In the preferred embodiment, the surrounding wall is formed by the folding and adjusting of a flexible sheet to provide side walls having a simplified and generally smooth and non-angular exterior, a bottom wall, a margin at which the perimeters of the folded and adjusted sheet are joined, such as by heat sealing, and an inner volume. Flexible material that is suitable for such purpose includes a layer or a laminate of layers of plastic, foil, or metalized polyester having a single sheet structure. Advantageously, by forming the package from a single sheet of such material, the package may be made sufficiently inexpensive so that the package may be discarded after the packaged fluid is consumed.

The margin includes an upper margin formed adjacent to an upper horizontal edge and completely across the upper width of the package. The upper margin includes a vertically extended margin portion and a vertically narrowed margin portion, the difference between which provides a margin gap that opens onto the inner volume. The gap is of a sufficient vertical height and of a sufficient horizontal width to accommodate and loosely retain an end of a light weight and generally buoyant dispensing tube positioned within the inner package volume and to thereby align the length of the tube so that the end of the tube opposite to the dispensing end, the intake end, is positioned generally adjacent to or is resting on the inner surface of the bottom wall.

The upper margin is sized and shaped and has a construction such that a portion of the upper margin may be removed—such as along a tear line that may be formed through the upper margin—to provide an aperture opening through the margin and to the gap through which first the dispensing end of the tube—loosely retained within the margin gap —then other portions of the tube positioned within the package may be pushed upward and out of the package indirectly by the application of manipulative pressure to the outer surface of the surrounding wall of the package. Such an application of pressure causes the level of the fluid within the package to correspondingly rise upwardly and the light weight dispensing tube to thereby float higher and proportionately out from the aperture. From the dispensing end exposed indirectly as a result of this pressure, a user can then draw or dispense liquid from the tube without touching the dispensing end of the tube. Upon removal of the manipulative pressure to the outer surface of the surrounding wall of the package, the flexible surrounding wall, the fluid, and the configurations of the aperture, the margin gap, the package inner volume, and the tube cooperate to allow the level of the fluid to lower and the portion of the dispensing tube exposed as a result of the application of the pressure to slide down within the inner volume of the package such as until the dispensing end returns to an unexposed position within the gap margin. As sanitarily stored within such an opened package, the dispensing tube is ready to be used to dispense additional amounts of the packaged fluid again upon the application of manipulative pressure to the outer surface of the surrounding wall of the package.

The sheet from which the side walls of the package are formed is sized and shaped such that the margin includes opposing side margin portions that extend adjacent to and along the generally vertical edges of the package and that are joined by the upper margin that extends adjacent to and along an upper horizontal edge of the package. Preferably, the opposing side margin portions include opposing lower side margin portions—that are axially aligned generally parallel to each other—and upper side margin portions—that are axially aligned such that each of the upper side margin portions angle toward each other in the direction of the upper edge. Such a package includes an inner volume of the package whose capacity to hold the packaged liquid with height decreases with height of the package. A package having such a structure is generally easier to stand and remain stable in an upright position even when filled. Such a difference in capacity advantageously allows the level of the liquid and thereby the light weight dispensing tube positioned within the inner volume to be quickly raised and lowered by the simple manipulation of the side walls particularly adjacent to the lower side margin portions.

The side walls each include generally adjacent to the bottom edge of the package lower side wall portions formed by the doubling of the single sheet side wall material to provide a thickened lower side wall. Such thickened lower side wall provides a simplified support structure that in addition to the above described relationship of the upper margin portion relative to the lower margin portion further allows the package to be stably positioned on a surface in a vertical orientation. The lower margin includes a generally smooth and non-angular lower edge and smooth and non-angular exterior face such that side walls extending upward from the margin face are similarly smooth and non-angular. Advantageously, a lower edge that is smooth and non-angular allows the package to rest stably on a surface. Furthermore, a lower margin and side walls that are generally smooth and non-angular and pliant allow the side walls to easily respond to the amount and direction of the pressure applied to the exterior surface of the side walls such as the manipulative pressure applied to the surface of the side walls during the use of the system or when the package is stored for or during shipment or while otherwise being carried or transported.

Accordingly, it is a general object of the present invention to provide an improved system by which fluids may be dispensed.

Also an object of the present invention is to provide a system including a package having a structure such that the package may be readily opened for the dispensing of fluid from the package.

An additional object of the present invention is to provide a system including a package having a structure such that a dispensing tube can be stored within the inner volume of the package.

Another object of the present invention is to provide a system including a package having a structure such that a dispensing tube can be maintained in a position within the inner volume of the package such that the dispensing end of the tube may be readily moved out from within the package in order to allow a user to draw fluid from the package.

Another object of the present invention is to provide a system including a package having a flexible structure such that, after the package is opened, the dispensing end of the tube can be moved out from within the package by manipulation of the sides of the package and without touching the dispensing end of the tube.

An added object of the invention is to provide a system including a package having a simplified construction in order that the system may be manufactured easily and at a low cost and such that the package may be discarded after a single use.

These and other objects, features, and advantages of the invention will be clearly understood and explained with reference to the accompanying drawings and through a consideration of the following detailed description of the preferred embodiments.

DESCRIPTION OF THE PARTICULAR EMBODIMENTS

Figure 1:
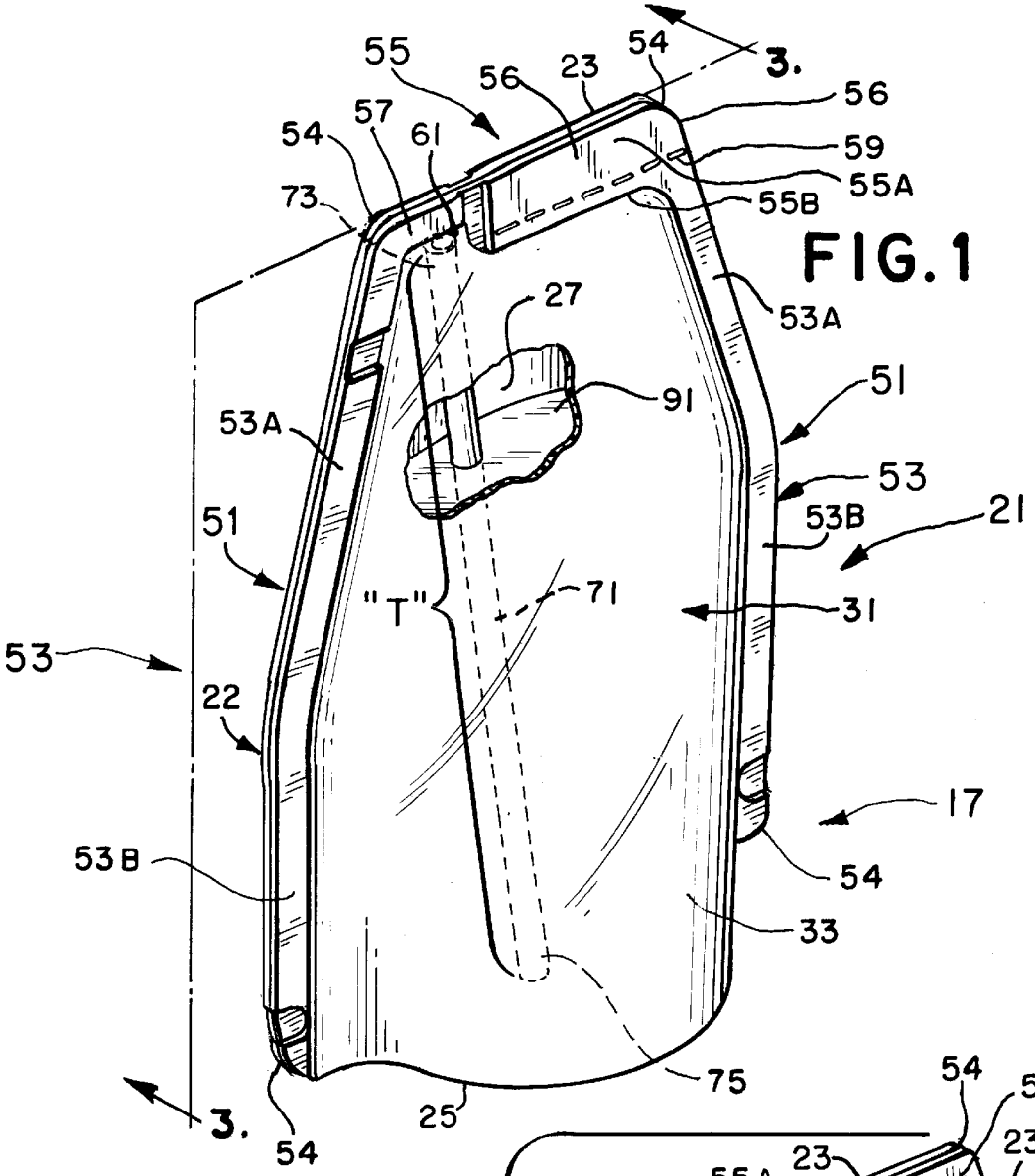
FIG. 1 is a partially cut-away perspective view of the system according to the invention.

A drinking system according to the present invention is generally designated as 17 in FIGS. 1 through 7.

Drinking system 17 includes a package 21 having a size and shape and a structure such that a portion of a tube 71 retained within the package may be extended above the package—simply by the application of manipulative pressure to the exterior of the package—and drawn back into the package—when the manipulative pressure is withdrawn—for the sanitary dispensing of fluid.

Package 21 is formed by the joining of flexible material to provide a surrounding wall 31 including opposing side walls 31A and 31B and bottom wall 41 that defines an inner volume 27 in which a fluid 91 may be retained. The specific type and structure of the materials and method used to form the package 21 will vary according to the nature of the fluid 91 held within the system and the dispensing requirements. The illustrated embodiment of the package 21 may be formed by the folding and adjusting of a flexible sheet of material. The flexible sheet of material may be formed from a layer or multiple layers joined as a laminate of plastic, foil, or metalized polyester. One preferred embodiment includes layers of P.E.T. having a 48 gauge thickness joined as a laminate layer. The material may be processed to provide the preferred embodiment such as by pulling the material from rollstock as a single sheet through a series of tension rolls and subjecting it to U.V. light treatment, folding the material—such as in half—to provide two sections, and adjusting the folded material—such as by pushing the sheet into another fold—to create a gusset. The dispensing tube 71 then may be inserted into the inner volume 27 formed by the folding and adjusting of the material. The material with tube 71 inserted may be joined—such as by heat sealing—to form the vertical margin portions 53 and a bottom gusset. The completed package may be then cut from the web and filled with liquid and the top of the side walls joined—such as by heat sealing—to form the upper margin 55 and thereby close the package 21.

More particularly, the sheet from which the side walls 31A and 31B and the bottom wall 41 may be formed are joined by heat sealing or other type of permanent bonding along the perimeters of the sheet to define a margin 51. The sheet from which the side walls 31A and 31B of the package 21 are formed is sized and shaped such that the margin 51 includes opposing vertical margin portions 53 that extend adjacent to and along the generally vertical edges 22 of the package 21 and that are joined by an upper horizontal margin 55 that extends adjacent to and along an upper horizontal edge 23 of the package.

The upper horizontal margin 55 formed adjacent to the upper edge 23 includes a vertically elongated margin portion 56 and a vertically narrowed margin portion 57, the difference between which provides a margin gap 61 opening onto the inner volume 27. The gap 61 is of a sufficient vertical height "Y" and sufficient horizontal width "X" to accommodate and loosely retain an end 73 of the dispensing tube 71 positioned within the inner package volume 27 and to thereby align the axial length of the tube "T" so that the intake end 75 of the tube 71 that is opposite to the dispensing end 73 is positioned generally adjacent to the inner surface 45 of the bottom wall 41. The intake end 75 of the tube 71 in this position advantageously allows all or nearly all of the fluid 91 within the package 21 to be dispensed or drawn from the package. Because the tube 71 is not bound but only loosely retained within the package 21, the tube may be easily moved to allow all or nearly all of the fluid 91 to be dispensed or drawn from the package.

Figure 1A:
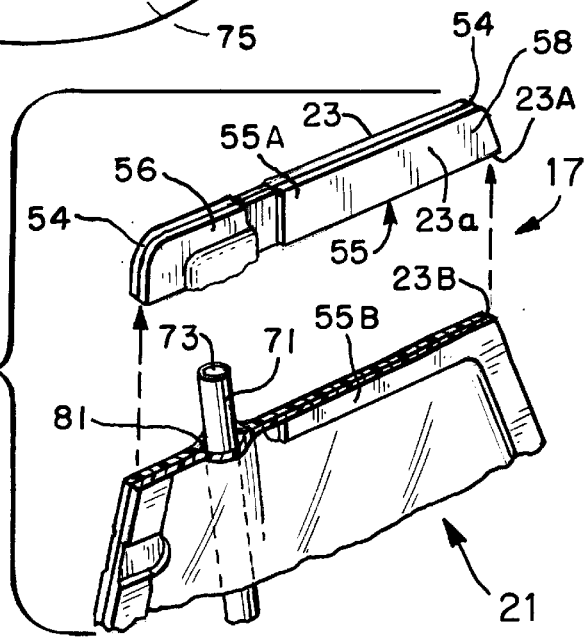
FIG. 1A is a partially cut-away perspective view of the embodiment of the system illustrated in FIG. 1 showing a portion of the upper margin removed from the package to provide an aperture through the margin and to the inner volume through which the dispensing tube may be pressured upward.
Figures 2, 3, 4:
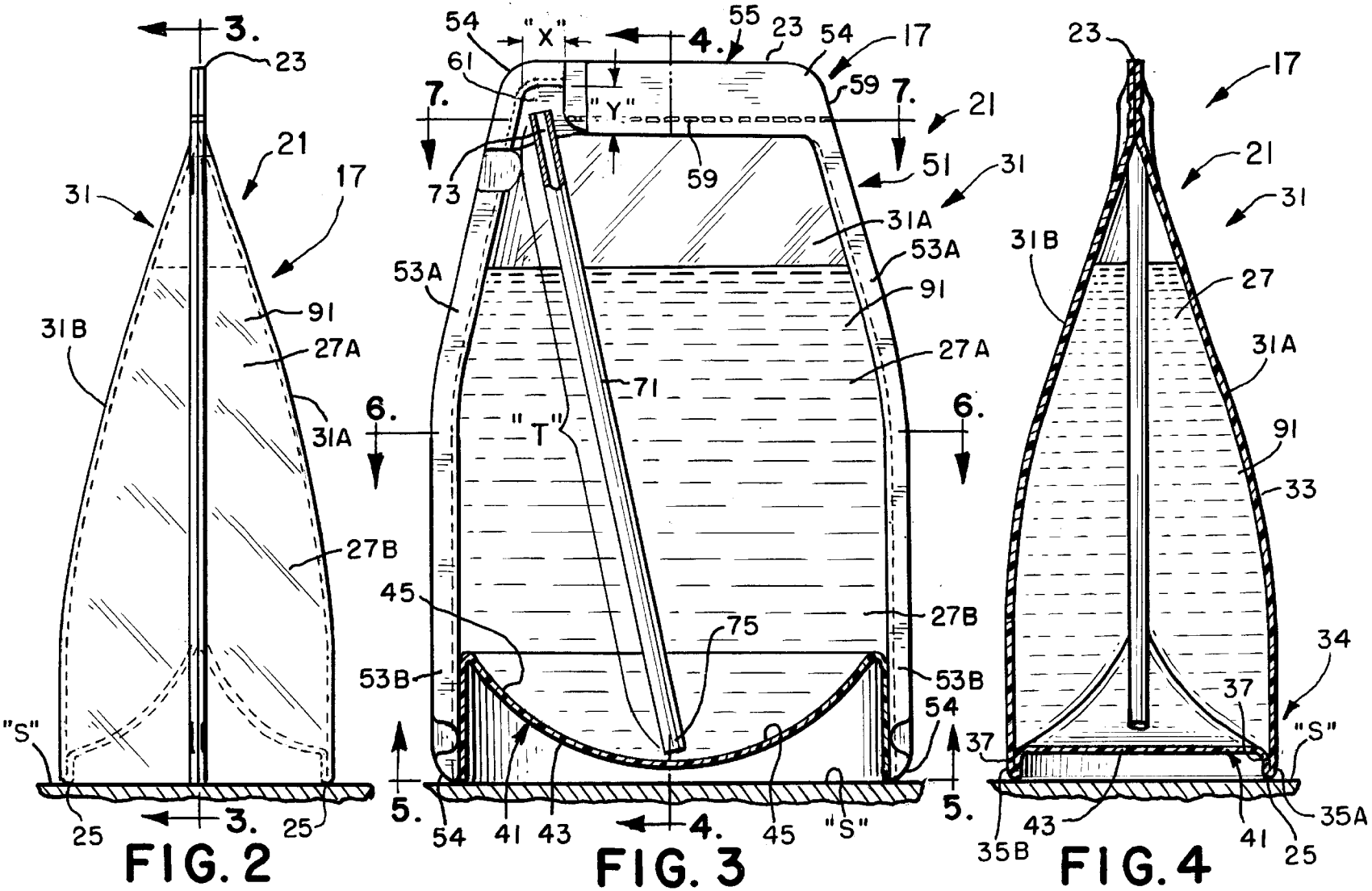
FIG. 2 is a side view of the system filled with liquid and sealed and supported on the lower edge of the package side walls.
FIG. 3 is a cross-sectional view along the line 3—3 of FIG. 2.
FIG. 4 is a cross-sectional view along the line 4—4 of FIG. 3.
Figure 5:
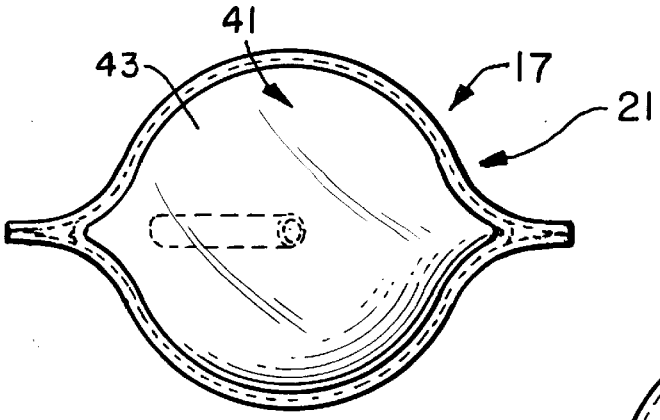
FIG. 5 is a view of the system from below and along line 5—5 of FIG. 3.
Figure 6:
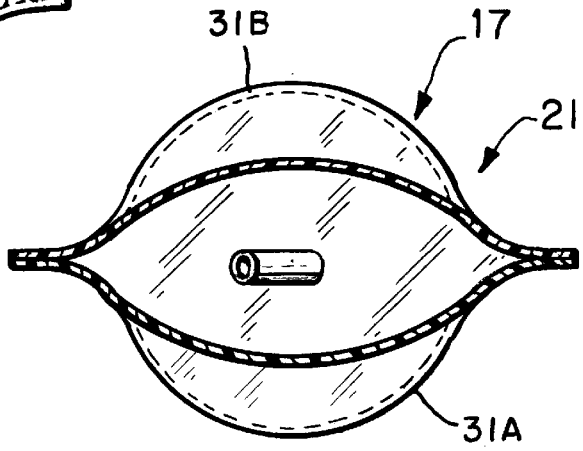
FIG. 6 is a cross-sectional view of the system along the line 6—6 of FIG. 3; and, FIG. 7 is a cross-sectional view of the system along the line 7—7 of FIG. 3.
Figure 7:
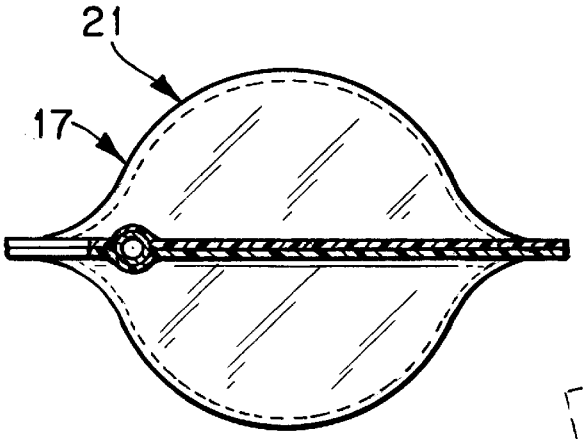
Figure 3A:
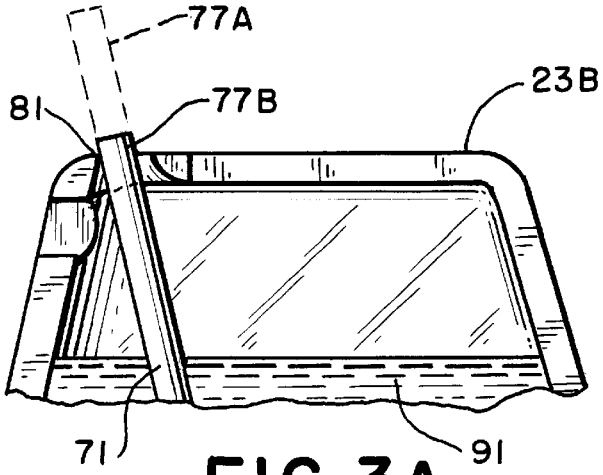
FIG. 3A is a partially cut-away front elevational view of the embodiment system filled with liquid and showing a portion of the upper margin removed to provide an aperture through which the dispensing tube is shown extended including in phantom in response to pressure applied to the side walls of the package.

The upper margin 55 is sized and shaped and has a construction such that a portion 55A of the upper margin may be removed—such as along a tear line 59 that may be formed through a part of or the full length of the upper margin—to provide an aperture 81 adjacent to the margin gap through which the tube 71 retained within the package 21 may be indirectly pushed by the application of manipulative pressure to the surrounding package wall 31. FIG. 1A illustrates the upper portion 55A separated from the lower portion 55B of the margin that remains on the package 21 to provide a lower tear edge 23B and an upper tear edge 23A and the dispensing end 73 of the tube 71 projected out from the aperture 81 and above the lower tear edge 23B by application of manipulative pressure to the surface 33 of the surrounding wall 31 or by the floating action of a lightweight embodiment of the tube 71 in the fluid 91. FIG. 3A illustrates the dispensing end 73 of the tube 71(in phantom) in a dispensing position 77A above the lower tear edge 23B as such projected. From the dispensing end exposed indirectly as a result of this pressure, a user can then draw liquid through the tube without touching the dispensing end of the tube. Upon removal of the manipulative pressure applied to the surrounding wall 31, the dispensing tube 71 may slide down—such as to the position 77B illustrated in FIG. 3A or lower, depending upon the amount of fluid 91 within the package 21, such as until the dispensing end 73 returns to a position between the gap margin 61.

The dispensing tube 71 of the self-contained drinking system 17 is of a generally light weight, simplified construction preferably formed from a material such as a plastic that readily retains its shape even when immersed in a liquid for an extended period of time yet is preferably inexpensive so that the package and enclosed tube may be discarded upon consumption of the fluid. The tube 71 sized and shaped—such as the illustrated thin tubular axial construction—to facilitate the retention of the dispensing end 73 of the tube generally within the margin gap 61 and the positioning of the intake end 75 of the tube generally adjacent to or resting on the inner surface 45 of the bottom wall 41 of the package 21 and thereby allow all or nearly all of the fluid within the package to be dispensed from the package.

Preferably, the opposing vertical margin portions 53 include opposing lower side margin portions 53B that are aligned along individual axes that are generally parallel to each other and upper side margin portions 53A that are aligned on individual axes such that each of the upper side margin portions 53A angle toward each other in a vertical direction toward the upper edge 23. Such a structure defines an inner volume 27 that includes an lower inner volume 27B that may have a large capacity and hold a larger volume of fluid 91 relative to that volume of fluid that may be held within the upper inner volume 27A. The margin may include rounded corners 54 to improve the safety of the package 21 and in order to lessen the likelihood of damage or injury that sharpened corners may cause.

Side walls 31A and 31B include a supporting structure 34 that in addition to the relationship of the upper side margin portion relative to the lower side margin portion and the resultant decreased upper inner volume 27A relative to the lower inner volume 27B further facilitates the stable positioning of the package 21 on the bottom edge 25 on a surface "S". The supporting structure 34 includes lower side wall portions 35A and 35B, respectively. As illustrated for example in FIG. 4, the supporting structure 34 includes lower side wall portions 35A and 35B having an additional material thickness 37 to facilitate the stable support of the package 21. The material thickness 37 is provided by the above described folding of the material during the preparation of the package 21. Preferably, the lower side wall portions 35A and 35B provide a structure such that, the package when filled as intended, the outer surface 43 of the bottom wall 41 is a vertical height "H" above and thereby makes no or little contact with the surface "S" on which the package may be vertically positioned.

The flexible material from which the side wall 31 is constructed allows the side wall to expand outward in response to the weight of the fluid contained within the package 21 and generally stiffen. Such stiffened side wall allows the side wall 31 to further facilitate the support of the package 21 in a generally vertical position when the package is positioned such that the lower edge 25 of the side walls 31A and 31B are allowed to rest on a horizontal surface "S". The package 21—as filled with fluid 91 and, as a result of which, the side walls 31A and 31B are expanded and stiffened—is illustrated for example in FIGS. 2 through 4 as resting on a horizontal surface "S". It will be appreciated that the horizontal surface "S" may, for example, be a table top or similarly oriented surface.

The flexible construction of the bottom wall 41 allows the bottom wall—in response to the weight of the fluid 91 contained within the package 21—to expand outward and—in response to the manipulative pressure placed on the side walls 31A and 31B—to be compressed as the side walls 31A and 31B are pushed inward, thereby facilitating the dispensing of fluid 91 through the tube 71 from the package.

Further advantageously, the difference in the inner volume 27 allows the level of the fluid 91 contained within the inner volume 27 of the package 21 to rise particularly quickly in response to the application of manipulative pressure to the outer surface 33 of the side walls 31A and 31B adjacent to the lower inner volume 27A, thereby facilitating the projection of the dispensing end 73 of the tube 71 from within the inner volume 27 and the draw of fluid 91 therefrom.

It will be understood that the embodiments of the present invention which have been described are illustrative of some of the applications of the principles of the present invention. Numerous modifications may be made by those skilled in the art without departing from the true spirit and scope of the invention.

What is claimed is:

1. An improved self-supporting, vertically-stable package of the type constructed from a side wall and a bottom wall united at their perimeters to form a surrounding wall and an inner volume in which fluid may be held, the improved self-supporting, vertically-stable package comprising:

a flexible sheet folded and adjusted to provide the surrounding wall and joined at a margin to provide the inner volume and flexible side walls and a flexible bottom wall that generally stiffen upon filing of said package with the fluid thereby providing vertical support to said package, said flexible bottom wall including a concave inner surface with centrally-located lowermost area;

said flexible side walls including a supporting structure, said supporting structure including lower side wall portions having an additional thickness of flexible material thereby providing further said vertical support to said package, said flexible side walls further including a generally smooth and non-angular lower edge thereby providing vertical stability to said package;

said margin including opposing vertical margin portions that form stiffened vertical edges of said package, said stiffened vertical edges thereby providing further said vertical support to said package;

said opposing vertical margin portions joined by an upper horizontal margin that extends generally along an upper horizontal edge of said flexible side walls, said upper horizontal margin including a gap that opens generally vertically relative to and within the inner volume of said package, said upper margin including a upper margin portion separable from a lower margin portion to form a horizontally-aligned lower tear edge having an aperture adjacent to said gap;

a dispensing tube positioned within the inner volume and sized and shaped such that said dispensing tube can slide through said aperture, said dispensing tube including an intake end located adjacent to said centrally-located lowermost area and a dispensing end positioned in a unexposed position generally below said horizontally-aligned lower tear edge when said upper margin portion is separated from said lower margin portion and said flexible sidewalls are not compressed by application of manipulative pressure on exterior surface of said flexible side walls;

whereby the application of the manipulative pressure on said exterior surface of said flexible sidewalls projects said dispensing end of said dispensing tube out from said aperture and by release of the manipulative pressure said dispensing tube slides down and within the inner volume for sanitary storage of and further sanitary dispensing of the fluid from said dispensing tube.

2. The improved self-supporting, vertically-stable package as defined in claim 1 wherein said opposing vertical margin portions include opposing upper side margin portions.

3. The improved self-supporting, vertically-stable package as defined in claim 2 wherein said opposing lower side margin portions are axially aligned to parallel each other and said upper side margin portions are axially aligned to angle toward each other in a upper vertical direction thereby defining the inner volume as including a lower inner volume and an upper inner volume, said upper inner volume having a fluid retention capacity reduced relative to said upper inner volume such that the application of the manipulative pressure on said exterior surface of said flexible sidewalls adjacent to said lower inner volume raises level of the fluid within the inner volume and projects said dispensing end of said dispensing tube out from said aperture and the release of the manipulative pressure lowers the level of the fluid and said dispensing tube slides down and within the inner volume for sanitary storage of and further sanitary dispensing of the fluid from said dispensing tube .

4. The improved self-supporting, vertically-stable package as defined in claim 1 wherein said upper margin includes a tear line formed through said upper margin to facilitate the separation of said upper margin portion from said lower margin portion to form said horizontally-aligned lower tear edge having said aperture adjacent to said gap.

5. The improved self-supporting, vertically-stable package as defined in claim 1 wherein said dispensing tube is formed from a light weight stiff material whereby said dispensing tube may quickly respond to changes in said level of the fluid within the inner volume.

6. The improved self-supporting, vertically-stable package as defined in claim 1 wherein said supporting structure of said flexible side walls includes said lower side wall portions formed from a double thickness of said flexible sheet to facilitate the vertical support of said package.

7. The improved self-supporting, vertically-stable package as defined in claim 1 wherein said flexible sheet is formed from a laminate of generally flexible materials.

* * * * *